US006319040B1

(12) United States Patent
Chang

(10) Patent No.: US 6,319,040 B1
(45) Date of Patent: Nov. 20, 2001

(54) PLUG ELECTRICAL CONNECTOR

(75) Inventor: Yao-Hao Chang, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/603,114

(22) Filed: Jun. 22, 2000

(30) Foreign Application Priority Data

Feb. 22, 2000 (TW) ..... 089202837 U

(51) Int. Cl.[7] ..... H01R 13/629
(52) U.S. Cl. ..... 439/352
(58) Field of Search ..... 439/350–358

(56) References Cited

U.S. PATENT DOCUMENTS 5,934,942 * 8/1999 Patel et al. ..... 439/610
6,113,413 * 9/2000 Cronin et al. ..... 439/352
6,132,231 * 10/2000 Suzuki ..... 439/352
6,132,233 * 10/2000 Fukuda ..... 439/352
6,146,180 * 8/1999 Betker et al. ..... 439/352

* cited by examiner

*Primary Examiner*—Gary Paumen
(74) *Attorney, Agent, or Firm*—Wei Te Chung

(57) ABSTRACT

A plug electrical connector comprises an insulative housing 30 receiving a plurality of conductive contacts 40, a base 20 defining a pair of slots 232 at both side walls 23 thereof and a receiving space 22 therebetween for receiving the housing, a cable end 6 extending into the receiving space for electrical connection with the contacts, a pair of latching members 50 received in the slots and a cover 10 engaging with the base. Each latching member comprises a lock arm 51 forming a tab 511 at a middle portion thereof and a barb 512 at a free end thereof for latching with a mating connector. The tab comprises a transition portion 5110 extending upward and inward toward the receiving space and an abutment 5111 extending upward from the transition portion. Thus, the distance between the abutments is narrower than the distance between the lock arms, whereby the width of the cover and the base, which designates an overall width of the plug connector, can reduced accordingly, compared with the width of the prior art plug connector.

1 Claim, 4 Drawing Sheets

PLUG ELECTRICAL CONNECTOR

BACKGROUND OF THE INVENTION

The present invention relates to a plug electrical connector, and particularly to a plug connector with a reduced width.

Electrical components in a computer need to be smaller, thinner and shorter to meet the developmental trend toward miniaturization in computers. U.S. Pat. No. 5,934,942 discloses a prior art electrical connector 1' as shown in FIG. 4. The electrical connector 1' comprises a base 20', an insulative housing 30' receiving a plurality of conductive contacts 50' and being partially received in the base 20', an upper cover 10' mating with the base 20' and a pair of latching members 40' partially retained in the base 20'. Each latching member 40' comprises a retaining portion 42' retained in a slot (not labeled) defined in the base 20' and a resilient portion 41' extending from and aligned with the retaining portion 42'. A barb (not shown) is formed on a free end of the resilient portion 41' of each latching member 40' for latching the electrical connector 1' with a mating connector (not shown). The upper cover 10' comprises a pressing portion 11' stamped and formed for pressing the resilient portions 41 ' of the latching members 40'. In use, the pressing portion 11' is pressed downward against the resilient portions 41', causing the resilient portions 41' to bend downward. Thus, the barbs of the resilient portions 41' will bend downward at the same time to facilitate extraction of the plug connector 1' out of the mating connector. It can been easily seen that the width of the pressing portion 11 ' needs to be wider than the distance between the pair of resilient portions 41', and thus the width of the retaining portions 42' of the latching members 40', which unavoidably causes the entire electrical connector 1' to need a large overall width to accommodate the pressing portion 11'.

Hence, an improved electrical connector is required to overcome the disadvantages of the prior art electrical connector.

BRIEF SUMMARY OF THE INVENTION

A main object of the present invention is to provide a plug electrical connector having a reduced width.

A plug electrical connector of the present invention comprises an insulative housing, a plurality of conductive contacts received therein, a base defining a receiving space for receiving the housing, a cable end extending into the receiving space for electrical connection with the contacts, a pair of latching members and a cover. The latching members are received in a pair of slots defined in opposite side walls of the base and each comprises an upper lock arm and a lower retaining arm separated from the upper arm by a slit. The upper lock arm comprises a tab at a middle portion thereof and a barb at a free end thereof to latch with a mating connector. The tab extends first upward and then inward toward the receiving space of the base and then extends straight upward, thus forming an inclined transition portion and an abutment above the transition portion. The cover defines an operating portion for pressing the abutments and thus needs to be slightly wider than the distance between the abutments. Since the abutments are located inward with respect to the lock arms, respectively, the width of the cover and the base which designate an overall width of the plug connector can be reduced accordingly, in comparison with the conventional plug connector.

Other objects, advantages and novel features of the invention will become more apparent from the following detailed description of the present embodiment when taken in conjunction with the accompanying drawings.

DETAILED DESCRIPTION OF THE INVENTION

Figure 1:
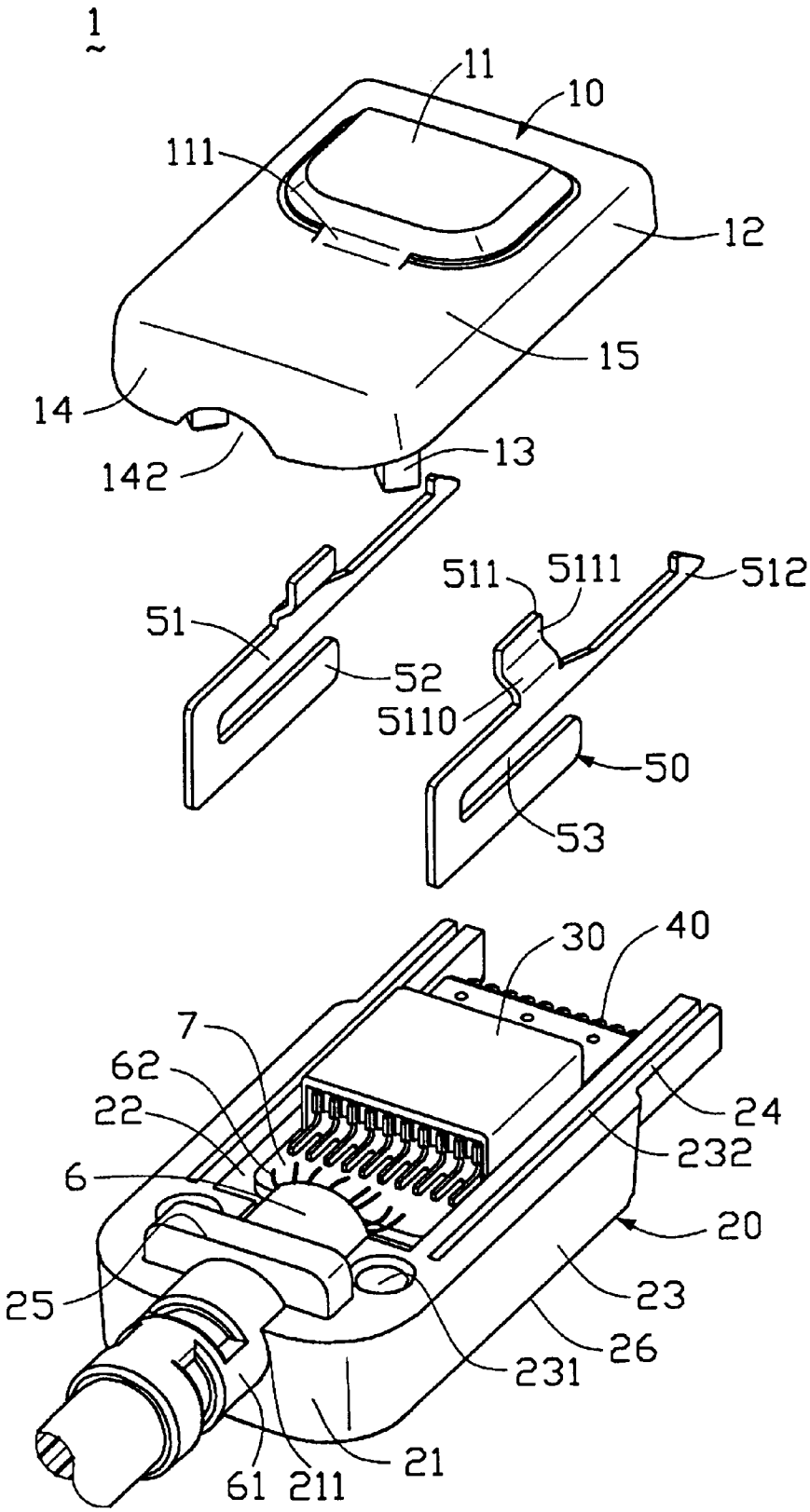
FIG. 1 is an exploded view of a plug electrical connector of the present invention.

Referring to FIG. 1, a plug electrical connector 1 of the present invention comprises a rectangular-shaped dielectric base 20, an insulative housing 30 receiving a plurality of conductive contacts 40 therein, a cover 10 and a pair of latching members 50.

The base 20 comprises opposite side walls 23, a bottom wall 26 and a rear portion 21 together defining a receiving space 22 therebetween for receiving the insulative housing 30. A pair of guiding posts 24 extends forward from two forward ends of the side walls 23 for guiding the plug connector 1 to mate with a mating connector (not shown). A pair of slots 232 is defined in the side walls 23 and extends through the guiding posts 24. A cable end 6 cramped by a metal ferrule 61 is retained in a semi-circular notch 211 defined in the rear portion 21 of the base 20 and extends into the receiving space 22. A strain-relief block 25 which is integrally formed on the cable end 6, is inserted into a slot (not labeled) in the rear portion 21 for resisting an overload pulling force acting on the cable end 6. The cable end 6 comprises a plurality of wires 62 for soldering to a printed circuit board 7 received in the receiving space 22 of the base 20. Additionally, a pair of holes 231 is defined in lateral sides of the top surface of the rear portion 21 near the cable end 6.

The insulative housing 30 defines a plurality of passageways (not labeled) receiving a corresponding number of conductive contacts 40. One end of each contact 40 is soldered to the printed circuit board 7 and thus establishes an electrical connection with a respective wire of the cable end 6. The other end of each contact 40 extends beyond a front face (not labeled) of the insulative housing 30 for mating with the mating connector, as is best seen in FIG. 2.

Referring to FIG. 1 again, the cover 10 comprises a top side 15, a rear flange 14 and opposite lateral flanges 12. An operating portion 11 is formed in the top side 15 and connects therewith only by a resilient strip 111 so that the operating portion 11 can be depressed downwardly by external force acting thereon. An arced recess 142 is defined in a middle portion of the rear flange 14. A pair of latching projections 13 depends downward from opposite sides of a rear end of the top side 15.

Figure 3:
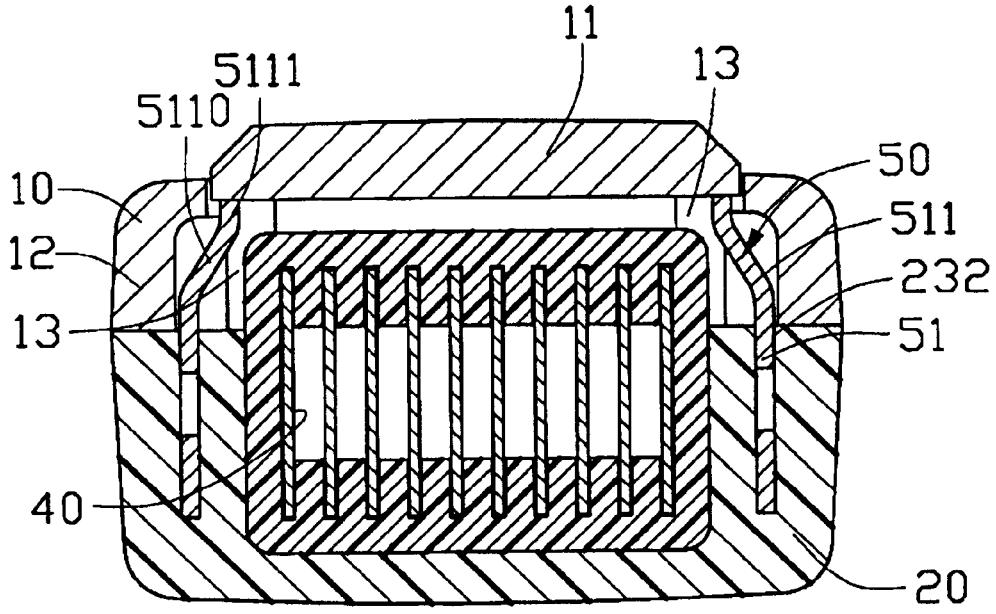
FIG. 3 is a cross-sectional view of FIG. 2 taken along line 3–3.

Each latching member 50 comprises an upper lock arm 51 and a lower retaining arm 52 parallel to one another, and is inserted into a respective slot 232 of the base 20. A slit 53 is defined between the lock arm 51 and the retaining arm 52 to provide a space for the lock arm 51 to be pressed downward. A tab 511 extends generally from a middle of the lock arm 51, first straight upward and then upward at a sideward angle, thereby forming an inclined transition portion 5110, and then forming a straightly upward abutment 5111 for receiving a downward pressing force from the operating portion 11. Thus, a distance between the two abutments 5111 is narrower than the distance between the two lock arms 51 of the latching members 50, as best seen in FIG. 3. Additionally, a barb 512 is formed on a free front end of each lock arm 51 for latching with a mating connector.

Figure 2:
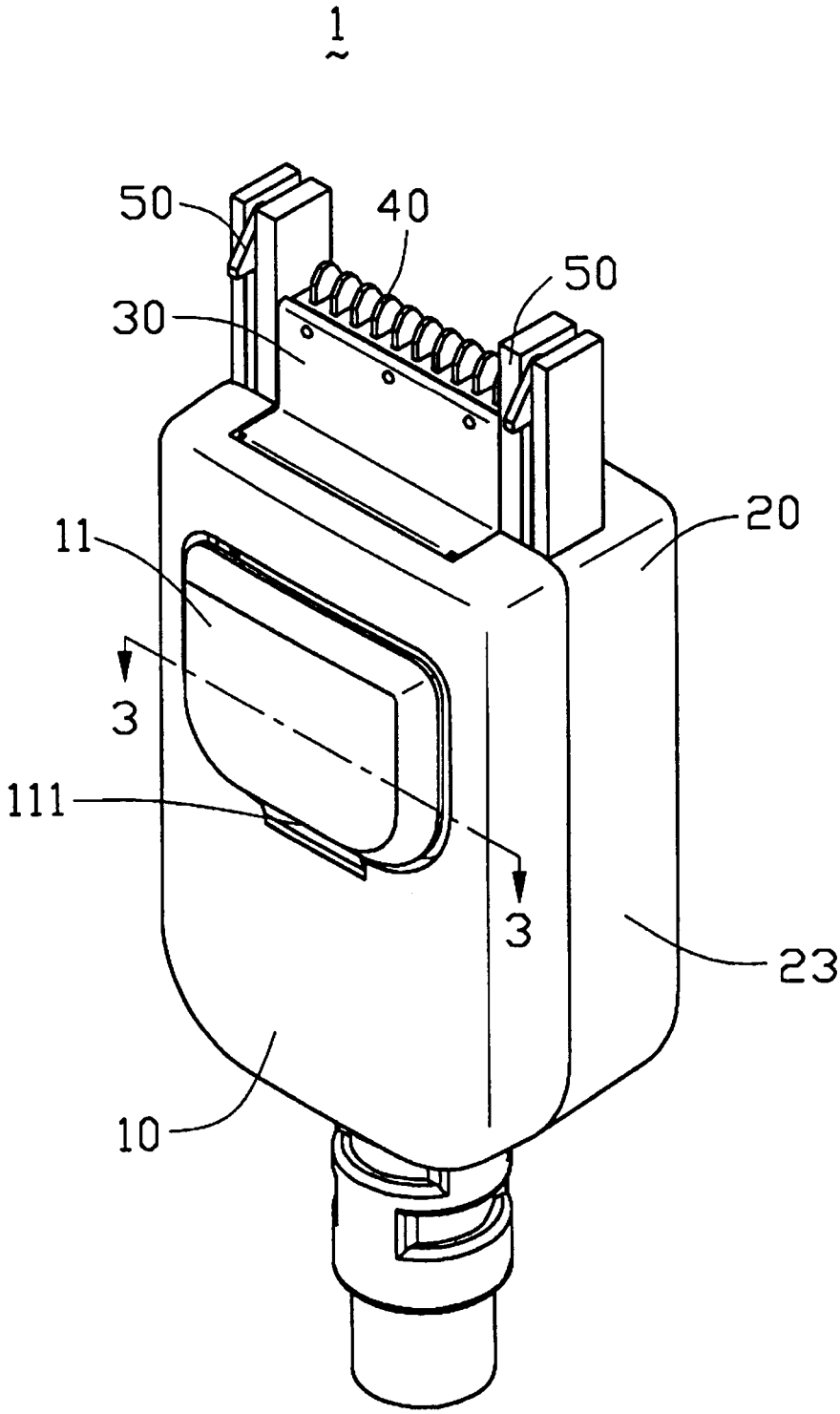
FIG. 2 is an assembled view of FIG. 1.

In assembly, referring to FIGS. 1 to 3, the contacts 40 are inserted into the housing 30, rear ends of the contacts 40 being soldered to the PCB 7, and wires 62 of the cable end 6 also being soldered to the PCB 7. The housing 30 with contacts 40, the PCB 7, and the cable end 6 with block 25 and metal ferrule 61 are all assembled into the base 20. The pair of latching members 50 are inserted in the slots 232 of the base 20 with both the tabs 511 and the barbs 512 thereof being exposed upward. The cover 10 is then engaged with the base 20 with the latching projections 13 latching in the holes 231 and the recess 142 thereof abutting the cable end 6. After the assembly, the operating portion 11 of the cover 10 contacts the two abutments 5111 of the latching members 50. When the operation portion 11 is depressed, a depressing force is transmitted to the lock arm 51 via the tabs 511 to cause the lock arms 51 and accordingly the barbs 512 to move downwardly. At the same time, the barbs 512 disconnect from the mating connector, whereby the plug connector 1 can be extracted out of the mating connector.

Figure 4:
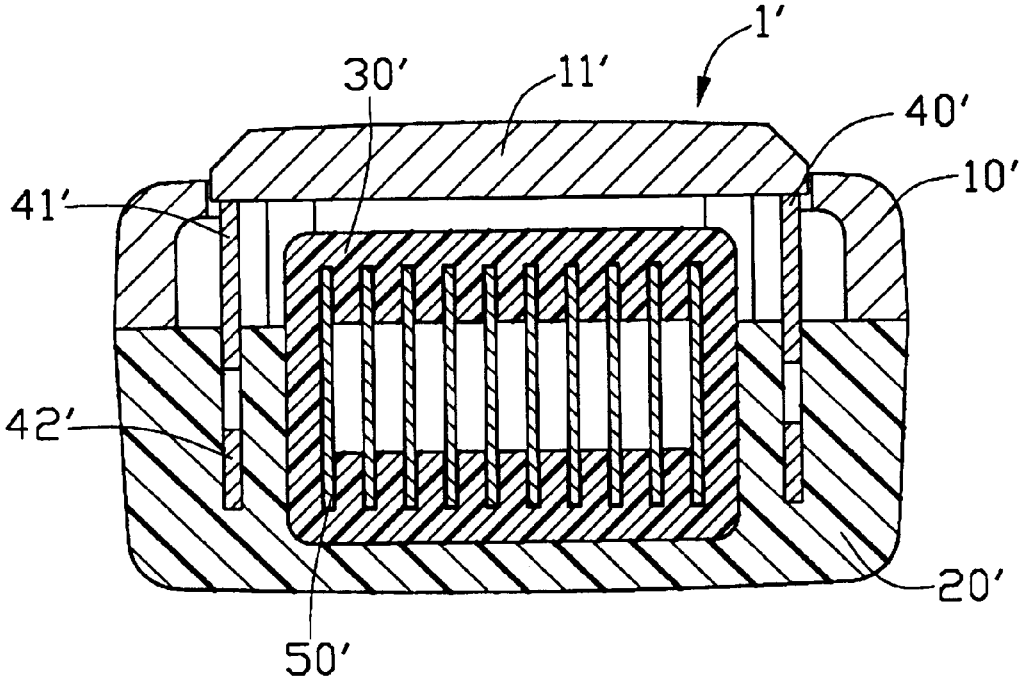
FIG. 4 (PRIOR ART)
FIG. 4 is a cross-sectional view of a prior art plug electrical connector.

According to the above description, it is clearly seen that the width of the operating portion 11 of the cover 10 can be reduced in comparison with the conventional pressing portion 11' of FIG. 4 since the abutments 5111 for engaging with the operating portion 11 are located inward of the lock arms 51, respectively. Therefore, the width of the cover 10 and thus the base 20 can be reduced, allowing an overall width of the plug connector to be reduced, compared with the conventional plug connector 1'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug electrical connector comprising:

a dielectric base having two opposite side walls each defining a slot therein;

an insulative housing receiving a number of contacts therein and being received in the base and between the two opposite side walls;

a cable extending into the base from a rear end thereof and having an electrical connection with the contacts;

a pair of latching members each having a retaining arm fixedly received in a corresponding slot, a lock arm located above and resiliently movable toward the retaining arm and having a barb at a free front end thereof for engaging with a mating connector, a tab extending first upwardly from the lock arm and then inwardly toward the housing, said tab forming an abutment at its upper end; and a cover fixed to the base and having a movable operating portion engaging with the abutments, whereby when the operating portion is depressed downwardly, the lock arms and the barbs move downwardly;

wherein the abutment of each latching member extends straight upward;

wherein a slit is defined between each lock arm and the corresponding retaining arm;

wherein a pair of latching projections depends downwardly from opposite sides of a rear portion of the cover to latch in a pair of holes defined in opposite sides of a rear portion of the base;

wherein a strain-relief block is integrally formed at an end of the cable for preventing the cable from being pulled out of the electrical connector by an overload force;

wherein a pair of guiding posts extends forwardly from front ends of the side walls of the base for guiding the plug electrical connector to mate with the mating connector.

* * * * *